United States Patent [19]

Miyasaka et al.

[11] 4,371,268

[45] Feb. 1, 1983

[54] TIME CORRECTING CIRCUIT FOR TIMEPIECE WITH ELECTROCHROMIC DISPLAY

[75] Inventors: Hiroshi Miyasaka; Shinji Yamada, both of Saitama, Japan

[73] Assignee: Rhythm Watch Company Limited, Tokyo, Japan

[21] Appl. No.: 219,910

[22] Filed: Dec. 24, 1980

[30] Foreign Application Priority Data

Dec. 28, 1979 [JP] Japan ..... 54-170966
Nov. 18, 1980 [JP] Japan ..... 55-162154

[51] Int. Cl.[3] ..... G04C 19/00; G04C 9/00

[52] U.S. Cl. ..... 368/82; 368/187; 340/785

[58] Field of Search ..... 368/82, 187, 223, 239; 340/785; 350/357

[56] References Cited

U.S. PATENT DOCUMENTS 3,950,936 4/1976 Oguet et al. ..... 340/785
3,987,433 10/1976 Kennedy ..... 368/239
4,060,974 12/1977 Natori et al. ..... 368/82
4,060,975 12/1977 Yamaguchi ..... 368/239
4,149,146 4/1979 Ebhard et al. ..... 368/239

*Primary Examiner*—Vit W. Miska
*Attorney, Agent, or Firm*—Koda and Androlia

[57] ABSTRACT

A time correction circuit for a timepiece with an electrochromic display which includes a timing circuit having counters counting time standard clock signals and for generating time display output signals, a time display circuit having an electrochromic display section displaying output signals from said counters, a correction mode changeover switch selectively switching between a time display mode and a time correction mode, a correcting circuit which works only when said correction mode changeover switch selects the correction mode to change the count in the counters, a writing and erasing control circuit for controlling the timing of the writing and the erasing of the electrochromic display section in response to the mode selected by the correction mode changeover switch and a correction pulse generating circuit for outputting time correction writing pulses of smaller pulse width than time correction writing and erasing pulses during the time display mode when the correction mode changeover switch selects the time correction mode to enable fast correction of the electrochromic display.

5 Claims, 10 Drawing Figures

TIME CORRECTING CIRCUIT FOR TIMEPIECE WITH ELECTROCHROMIC DISPLAY

BACKGROUND OF THE INVENTION

1. Field of the Invention

This invention relates to time correcting circuits for timepieces with electrochromic displays, and more particularly to a time correcting circuit which enables fast correction of the time in an electrochromic display.

2. Prior Art

Recently electrochromic (hereinafter referred to as EC) display elements have been put to practical use in digital or analog displays for electronic timepieces and such timepieces that utilize a EC display element provide better display action than conventional light emitting diodes or liquid crystal displays. The EC display element utilizes an electrochromic phenomenon wherein the application of a voltage to the EC material provided between two electrodes colors or discolors the material by an oxidation-reduction reaction. Biologen compounds, $WO_3$ in a thin film, etc. are known EC materials. Being different from light emitting diodes, EC elements can function with small electric current consumption and can provide a clear display under direct sunlight. In comparison with liquid crystal display, the EC display can obtain extremely vivid coloring and clear displays from all directions. In other words, the EC display does not have visual angle dependency and is preferable for the time display element for an electronic timepiece. The EC display is further characterized in that it provides a non-volatile memory function in that the color remains for a certain amount of time without the application of a voltage after coloring.

However, the EC display must be changed by a reverse voltage in order to erase the display due to the non-volatile characteristic thereof. This has a drawback in that the speed of writing and erasing is comparatively slow. It ordinarly takes about 1 to 2 seconds for writing and erasing and such time normally does not produce any problems during ordinary operation of the time display. However, in the case of time correction such slow speed of writing and erasing restricts the time required for correction of the time and fast correction of the EC display cannot be obtained.

SUMMARY OF THE INVENTION

Accordingly, it is the general object of the present invention to provide a time correcting circuit for a timepiece which utilizes a EC display which is improved to enable fast correction of the time.

In keeping with the principals of the present invention, the object is accomplished with a time correcting circuit for a timepiece with EC display which includes a timing circuit having counters counting time standard clock signals and timing a display time, a time display circuit having an EC display section displaying output signals from the counters, a correction mode selecting switch selectively selecting a time display mode and a time correction mode, a correcting circuit which works only when the correction mode selection switch selects the correction mode to change the contents of the counters, a writing and erasing control circuit controlling the timing of the writing and erasing of the EC display in response to the selected mode of the correction mode selecting switch and a correction pulse generating circuit for outputting a time correction writing pulse with a smaller pulse width than the usual writing and erasing pulses when the time correction mode is selected by the correction mode selecting switch whereby fast correction of the display can be performed by supplying writing and erasing pulses of a smaller pulse width for time correction of the EC display section during time correction.

In other words, the coloring action in the EC display is as a result of the appearance of a colored substance by a reduction reaction of the material and this results in a reversible reaction which can return the colored substance to its original colorless state. The degree of coloration, therefore, changes in accordance with the amount of electric charge supplied to the display electrode and the opposite electrode between which the EC material is provided. If the amount of voltage is kept constant, the amount of coloration is determined by the pulse width and the erasing pulse must have substantially the pulse width as the writing pulse.

The present invention makes note of this coloring phenomenon of the EC display and is characterized in that the intense and brilliant display of coloration is obtained by a display pulse having a sufficient width during ordinary time display function, while the degree of coloration is a little reduced upon utilizing a pulse having a smaller pulse width during time correction. In actual use, the display correction action is obtained even if the display is not so brilliant. Furthermore, since the electric charge supplied to the electrode is large at the initial period, even if the writing pulse width is set smaller, the degree of coloration is not proportional to the degree of decrease in the pulse width and a sufficiently visible display is obtainable. For example, if the pulse width is decreased to one half, the degree of coloration in the EC element is decreased to only about 70–80% and the display action required for time correction is sufficiently provided.

BRIEF DESCRIPTION OF THE DRAWINGS

The above-mentioned and other features and objects of the present invention will become more apparent by reference to the following description taken in conjunction with the accompanying drawings, wherein like reference numerals denote like elements and in which.

DETAILED DESCRIPTION OF THE INVENTION

Figure 1:
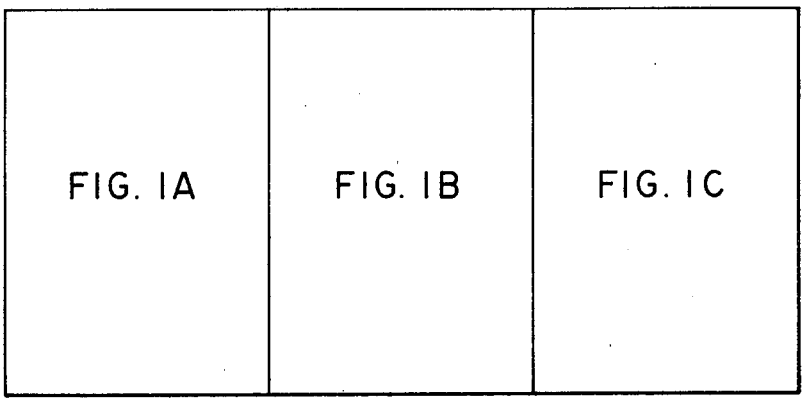
FIGS. 1A–1C are a circuit diagram illustrating a first preferred embodiment of a time correction circuit in accordance with the teachings of the present invention.

Referring more particularly to the drawings shown in FIG. 1 is a circuit diagram illustrating a first preferred embodiment of a time correction circuit in accordance with the teachings of the present invention.

In the first preferred embodiment, standard clock pulses from a time standard generator 10 including a crystal oscillator, etc. are supplied to a timing circuit 14 by way of a divider 12 after being converted into a pulse train having the required frequencies. In this embodiment, to the timing circuit 14 a 1 Hz pulse train is supplied from the divider 12 and from a modulo 60 counter 16, a modulo 10 counter 18, a modulo 6 counter 20, a module 12 counter 22 and a modulo 2 counter 24 is respectively provided a pulse train with a 60 second period, a one minute period, a ten minute period, a one hour period and a AM/PM signal. These signals are outputted to a time display circuit 26 as time display signals. In the time display circuit 26, an EC display section 28 is provided and it includes a AM/PM display electrode 30*a* consisting of a two-segment electrode, an hour units display electrode 30*b* consisting of eight segments, a ten minutes unit display electrode 30*c* consisting of seven segments, a one minute units display electrode 30*d* consisting of seven segments and an opposite electrode 32. Each signal from the above described timing circuit 14 is supplied to decoders 34*a*, 34*b*, 34*c* and 34*d* of the time display circuit 26 to be changed into time display signals. The outputs from each of the decoders 34 are supplied to input gates of display electrode drivers 38*a*, 38*b*, 38*c* and 38*d* consisting of three state inverters by way of AND gate 36*a*, 36*b*, 36*c* and 36*d* and each is further supplied to each of the display electrodes 30 after being converted into driving signals.

To the inputs of each of the AND gates 36 and each of the drivers 38 are supplied control signals from a writing and erasing control circuit which will be described hereinafter. In this preferred embodiment, in the time displaying state, the display in the EC display section 28 is renewed every 60 seconds. The display is also renewed every time correction signals are provided during the time correction mode.

To the opposite electrode 32 of the EC display section 28 is provided a voltage of reverse polarity to that of the voltage of the display electrode 38 from an opposite electrode driver 40 consisting of a three state inverter to obtain the electrochromic phenomenon described above. To the gate input of the opposite electrode driver 40 not only are provided signals from a writing and erasing control circuit which is described below, but also are provided control signals from an inverter 42. The inputs of each of the display electrode drivers 38 and the inverter 42 are grounded ($V_{ss}$) by way of a resistor 44. This display electrode drivers 38 and the opposite electrode driver 40 consist of a three state inverter respectively as described above and operates when a gate input of "H" is applied to generate a driving output corresponding to the input level to the relative display electrodes 30 and the relative opposite electrode 32. On the other hand, when a "L" is the gate input, the display electrode driver 38 and the opposite electrode driver 40 stay in the off state. The requested writing action is obtained only when the display electrodes 30 receive a "L" and the opposite electrode 32 receives a "H" in the EC display section and erasing action is obtained in the reverse manner when the display electrodes 30 become a "H" and the opposite electrode 32 becomes a "L".

In order to select and control the writing and erasing of the EC display section 28 and at the same to select the time display and the time correction writing and erasing, a control circuit 46 is provided. In the present embodiment, the erasing is performed when a 59 second pulse 100 corresponding to 59 seconds of display is supplied to the writing and erasing control circuit 46 from the modulo 60 counter 16 of the timing circuit 14. The writing is performed when a 60 second pulse 102 corresponding to 60 seconds is supplied. During ordinary time display, the writing and erasing control circuit 46 performs the writing and erasing every minute in accordance with the above described 59 second pulse and 60 second pulse. However, in the time correction mode the erasing and writing of the display are performed at any optional time when correction is required. In the present invention, in order to selectively change over from the time display mode to the time correction mode, there is provided a correction mode selecting switch 48. The correction mode selecting switch 48 includes a push button switch, etc. provided on the timepiece. One end of the correction mode selecting switch 48 is connected to a power source ($V_{dd}$) by way of a resistor 50 and the other end is grounded. In its OFF state a "H" signal is supplied to the writing and erasing circuit 46; while when the selecting switch 48 is switched ON a "L" signal is supplied to the writing and erasing control circuit 46. The correction mode selecting switch 48 selects the time display mode or the time correction mode. Selection of the time correction mode by turning ON the selecting switch 48 causes a correcting switch group 52 to be effective and correcting signals are supplied from the correcting switch group 52 to each counter of the timing circuit 14.

The correction switch group 52 includes a one minute unit correcting switch 54*a*, a ten minute unit correcting switch 54*b* and an hour unit correcting switch 54*c*, and correcting signals from each correcting switch are supplied to the modulo 10 counter 18, the modulo 6 counter 20 and the modulo 12 counter 22 by way of chattering prevention circuits 56*a*, 56*b* and 56*c*, respectively. Accordingly, everytime either of the switches is turned ON, the counted values of each of the counters 18, 20 and 22 are corrected and moved up one by one and fast correcting action can be performed in accordance with their operation.

In order to output the writing and erasing pulses for the time display, that is the writing and erasing pulses of smaller width for time correction than the 59 second pulse and 60 second pulse provided by the modulo 60 counter 16 in the time correction mode selected by the correction mode selecting switch 48, there is provided a correcting pulse generating circuit 58 to which a signal of 32 Hz is supplied from the divider 12 and at the same time the correcting signals of the correcting switch group 52 are supplied by way of OR gate 60.

The correcting pulse generating circuit 58 outputs the writing and erasing pulses of smaller pulse width for the time correction mode than the writing and erasing pulses for normal time display. Furthermore, in this embodiment, the pulses having a frequency of 1 Hz are used for the time correction pulse whereas the time display pulse has a frequency of 0.5 Hz. In order to provide the different width pulse, the correcting pulse generating circuit 58 is provided therein with a dividing circuit consisting of a Flip Flop (hereinafter referred to as FF) 60*a*, 60*b*, 60*c*, 60*d*, 60*e* and 60*f* and the pulse train of 32 Hz from the divider 12 is supplied to the dividing circuit consisting of the FF 60 group by way of AND gate 62. The other input of the AND gate 62 is supplied gate signals which start the counting output action of the 1 Hz signal of the dividing circuit from the correcting signals from the correcting switch group 52. In order to form the gate signals FF 64 and 66 are provided and the correcting signals are supplied from the OR gate 60 to the trigger input of FF 64 by way of OR gate 68 so that the generation of the $\overline{Q}$ output of the FF 64 to the other input of AND gate 62 starts the counting action of the correcting pulses. The $\overline{Q}$ output of the FF 64 is supplied to reset inputs of each FF 60 and FF 66 to perform a reset function after the output of correcting pulses. In order to reset the FF 64, the Q output of FF 64 and FF 66 are supplied to the reset input of FF 64 by way of OR gate 70. As described above, from the corrected pulse generating circuit 58 the correction pulses of small pulse width are supplied through the Q output of FF 60*e* when correcting signals are supplied from the correcting switch group 52.

The writing control circuit 46 does not only function as a writing and erasing function for the EC display section but also controls their timing in response to the mode selection of the correction mode change over switch 48. The control circuit 46 further includes a OR gate 72 which supplies the change over signals of the writing and erasing to the time display circuit 26 and OR gate 74 selectively supplies either the time display pulses or the time correction pulses to the display circuit 26. In other words, the 59 second pulse 100 and the 60 second pulse 102 from the timing circuit 14 which forms the writing and erasing pulses for the time display are supplied to the OR gate 76 of the writing and erasing control circuit 46, the output of which is supplied to one input of AND gate 78.

The output of AND gate 78 is supplied to OR gate 74. To the other input of AND gate 78 is supplied the output of the correction mode change over switch 48 and this correction mode change over signal is supplied to one input of AND gate 82 by way of an inverter 80 and at the same time to AND gate 84 together with the 60 second pulse 102. To the other input of the AND gate 82 is supplied the Q output of FF 64 of the correction pulse generating circuit 58 and the output of AND gate 82 is outputted to the OR gate 74. The output of the AND gate 84 is supplied to the OR gate 72 together with correcting pulses of 1 Hz from the correction pulse generating circuit 58. The output of the OR gate 72 is supplied to the input of the opposite electrode driver 40 by way of the inputs of each display electrode driver 38 in the time display circuit 26 and the inverter 42.

In the writing and erasing control circuit 48 is provided a FF 86, the trigger input of which is supplied the correction mode change over signal of the correction mode change over switch 48. The Q output of FF 86 is supplied to the trigger input of FF 66 of the correction pulse generating circuit 58, the Q output of which is supplied to OR gate 68. To the reset input of FF 86 is supplied the correcting pulse.

The first embodiment of the present invention is structured as described above and its operation is described hereinafter referring to the waveform chart of FIG. 2.

Figure 2:
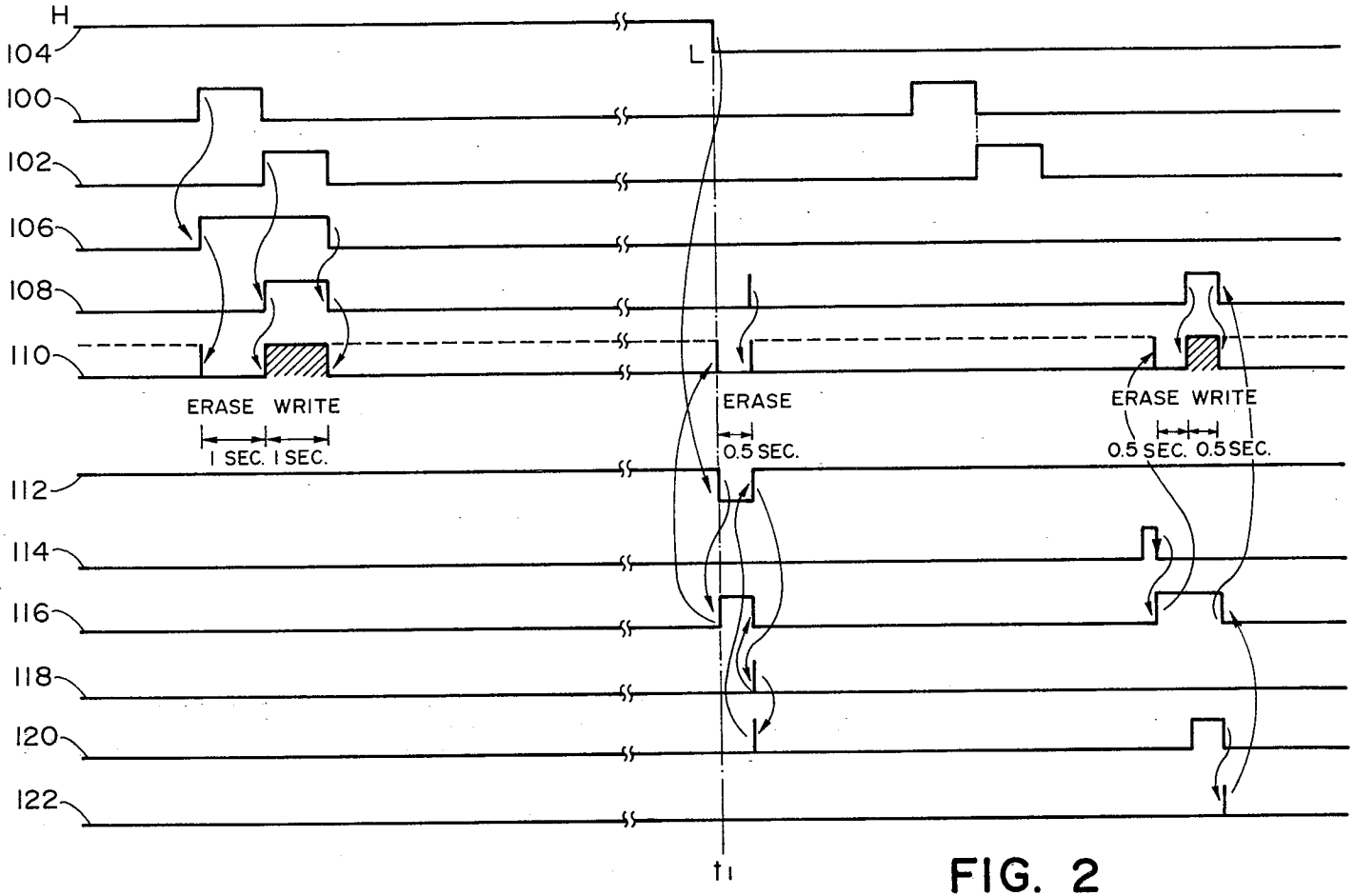
FIG. 2 is a waveform chart of each section in FIG. 1.
Figure 3A:
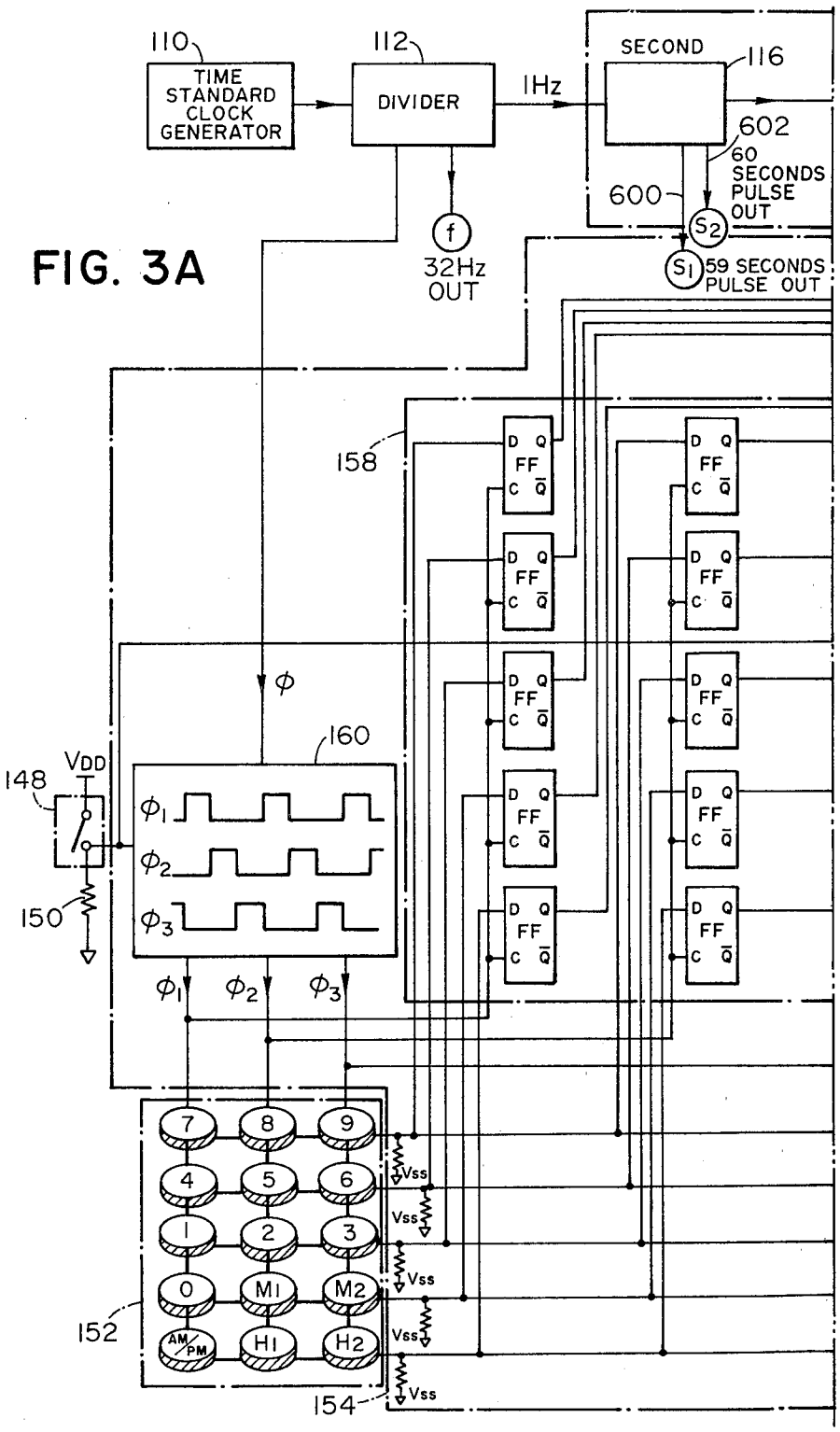
Figure 3B:
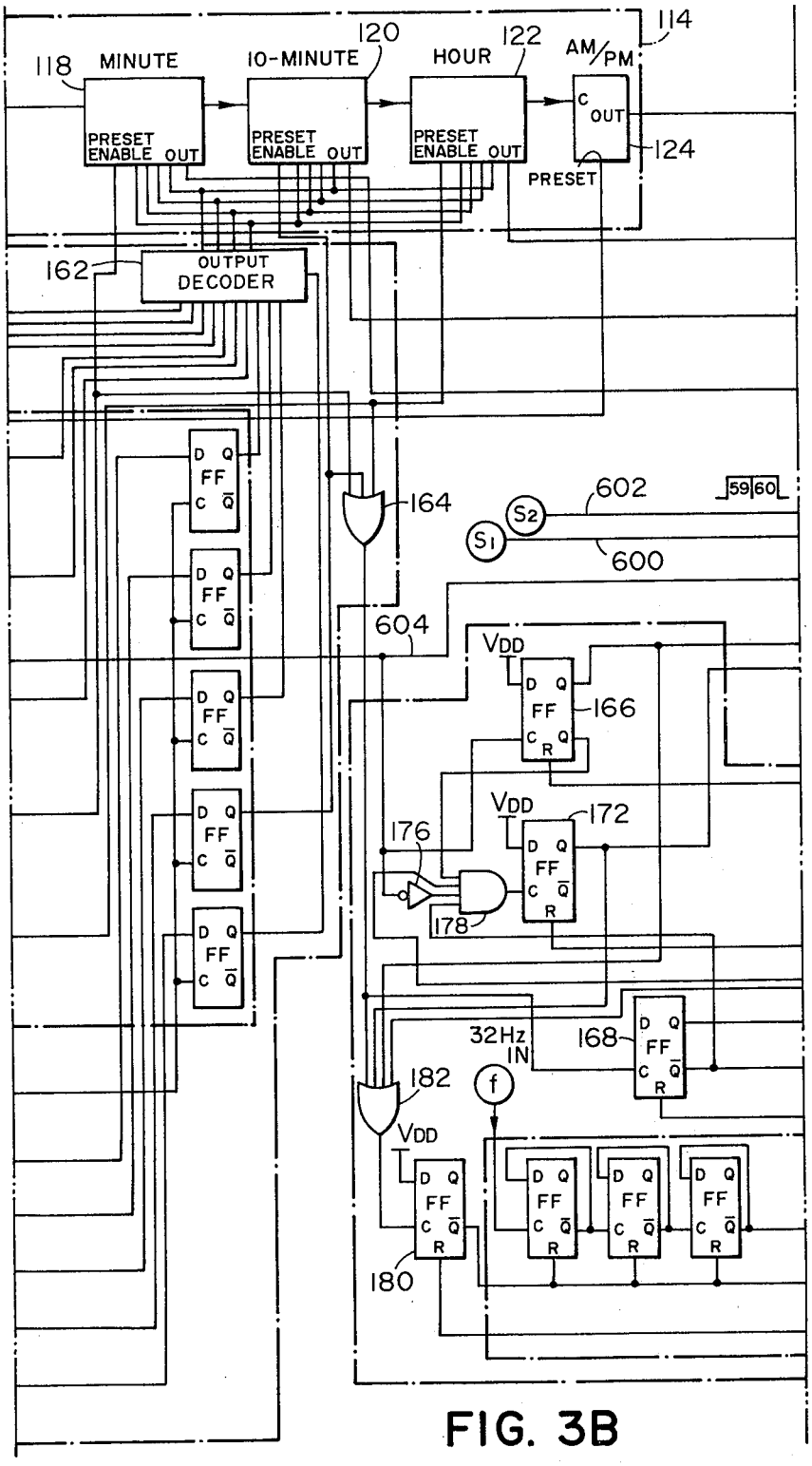
Figure 3C:
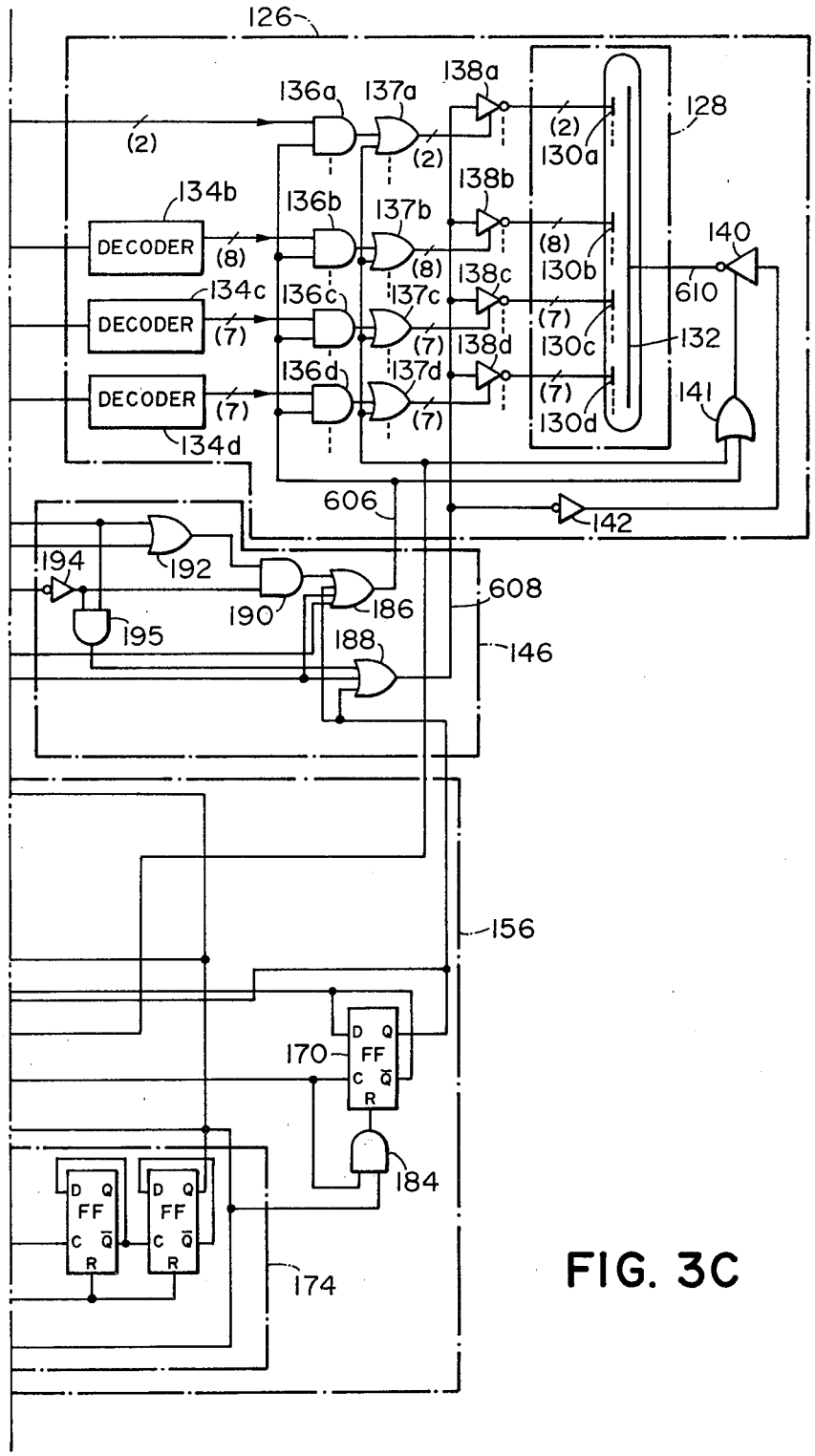

In FIG. 2, shown therein is the ordinary time display state unit the time t1 and the correction mode change over switch 48 is in the off state until such time t1. The correction mode change over signal 104 is a "H", and is changed over to a "L" by the turning on of the switch 48 at the time t1.

During normal time display, each of the FF 60 and 64 is in a reset state and time correcting pulses are not supplied. Since a correction mode change over signal 104 of "H" is supplied to the FF 86 in the writing and erasing controlling circuit 46, the FF 66 of the correcting pulse generating circuit 58 is in the trigger state. Both of the AND gates 78 and 84 of the writing and erasing control circuit 46 are in the open state in response to the correction mode change over signal 104. In this state when the 59 second pulse 100 having a pulse width of one second is supplied from the modulo 60 counter 16 of the timing circuit 14 to the writing and erasing control circuit 46, that "H" level signal passes to the OR gate 76, the AND gate 78 (signal 106) and the OR gate 74 to be supplied to the gate input of the display electrode driver 38 through each AND gate 36 of the time display circuit 26 and to the gate input of the opposite electrode driver 40 so that the EC display section 28 is in a state of preparation for writing or erasing. Since the output of the AND gate 84 is a "L" at this time, the output 108 of the OR gate 72 becomes a "L", the display electrode 30 of the EC display section 28 is a "H" and the opposite electrode 32 becomes a "L" so erasing action is performed in the EC display section during the "H" period of the 59 second pulse 100. Accordingly, the time displayed in the EC display section 28 can be completely erased by the 59 second pulse 100.

During the 60 second pulse 102, the 60 second pulse 102 is outputted and the output 106 of the AND gate 78 is maintained in a "H" state to invert the output 108 from the OR gate 72 by the output of AND gate 84 and the EC display section is in a state of preparation for writing. Consequently, the opposite electrode 32 of the EC display section 28 becomes a "H" and the display electrode 30 becomes a "L" to perform the writing action in the display section 28 so that the contents of the timing circuit 14 is written in the EC display section 28.

As described above, the ordinary time display is performed and described hereinafter is the time correction mode in reference to the hour units correction switch 54*c* at the time t1.

In the illustrated embodiment, the correcting action is started by the turning ON of the correction mode change over switch 48 and the decolorization of the EC display section 28 is lowered to one half when the switch 48 is ON. In the actual time correction to be described hereinafter, since the erasing pulse is smaller than the ordinary time display pulse width, the erasing pulse for correction could not completely erase the ordinary time display and the display prior to correction stay as it was and it is hard to perform the correction action. To overcome this the circuit has been designed to that upon selecting the correction mode, the colorization of the EC display section 28 enables complete erasure of the actual correcting time by the lowered colorizing degree of the EC display section 28. In other words, when the correction mode change over signal 104 is switched to "L" at the time t1, the FF 86 of the writing and erasing control circuit 46 is triggered and its Q output 112 is supplied to the trigger input of the FF 64 by way of the OR gate 68 so that the Q output of the FF 64 becomes "H" and is supplied to the time display circuit 26 by way of the AND gate 82 and the OR gate 74 to prepare for writing and erasing of the EC display section 28. At the time t1, the EC display section 28 starts the erasing action since the Q output 120 of FF 60*e* is "L", and at the same time the Q output 116 of FF 64 opens the AND gate to start the counting of the 1 Hz pulses by the dividing circuit consisting of the FF 60 group. After 0.5 seconds elapse from the time t1, the Q putput 120 of the FF 60*e* becomes "H" and FF 86 of the writing and erasing control circuit 46 is reset. Consequently, the FF 86 triggers the FF 66 of the correcting pulse generating circuit 58, the Q output 118 of which resets the FF 64, and subsequently, the $\overline{Q}$ output of the FF 64 resets all of the Flip Flops of FF 60 group. Accordingly, at the change over time of the correction mode, the weakened erasure of the EC display section 28 is performed and the writing action cannot be activated.

Utilizing the example of the hour units correction, the time correction action is described below.

By turning on of the hour correcting switch 54c, the correcting signal 114 is supplied to FF 64 by way of the OR gate 60 and FF 68 and at the rising edge as the Q output 116 of FF 64 becomes "H" is performed the preparation of the writing and erasing of the EC display section 28. At the same time, the Q output of FF 64 starts the counting of output pulses 120 of 1 Hz at the dividing circuit consisting of the FF 60 group via the AND gate 62. Since the correcting pulse 120 is in the "L" state 0.5 seconds after the correcting signal is supplied, the erasing signal is supplied to the EC display section 28 and the weakened display made when the correction mode change over switch 48 is turned ON is sufficiently erased by the erasing pulse of the smaller pulse width. The output 120 of the FF 60e is changed over into a "H" so that the EC display section 28 is put into the writing state and the correcting time can be written during the 0.5 seconds. When the pulse output of 1 Hz from the FF 60e is completed and its output becomes "L", the FF 60f is inverted and its Q output 122 resets the FF 64 to complete the resetting of each of the FF 60 group. Consequently, the output 108 of the OR gate 72 becomes "L" and the EC display section 28 completes its writing and erasing action to be able to finish the correcting action.

Incidentally, the dotted line position of the output 110 of the opposite electrode driver 40 in FIG. 2 shows the high impedance state, the writing and erasing of the EC display cannot be performed since each gate of the drivers 38 and 40 is in the "L" state.

In the embodiment, both pulse widths of the writing and erasing for time correction are set to be small and the setting of the writing pulse width to be small enables fast correction of the display.

As described above, when the correction mode change over switch 48 is in the ON state, the required time correction action can be obtained by turning on one by one each of the correcting switch group and the writing and erasing of the EC display section 28 is performed in a short time since the time correction is performed utilizing a time correction pulse of a smaller width than the pulses during ordinary time display. Furthermore, it should be apparent that during correction, the time displayed at the EC display section 28 is a little thinner and a little weaker in coloring than the ordinary time display but it is possible to obtain sufficient display for correction.

Figure 3:
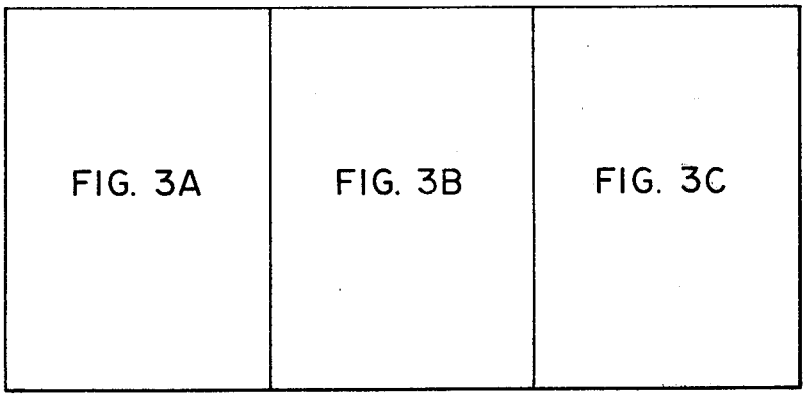
FIGS. 3A–3C are a circuit diagram showing a second preferred embodiment of a time correction circuit in accordance with the teachings of the present invention.
Figure 1A:
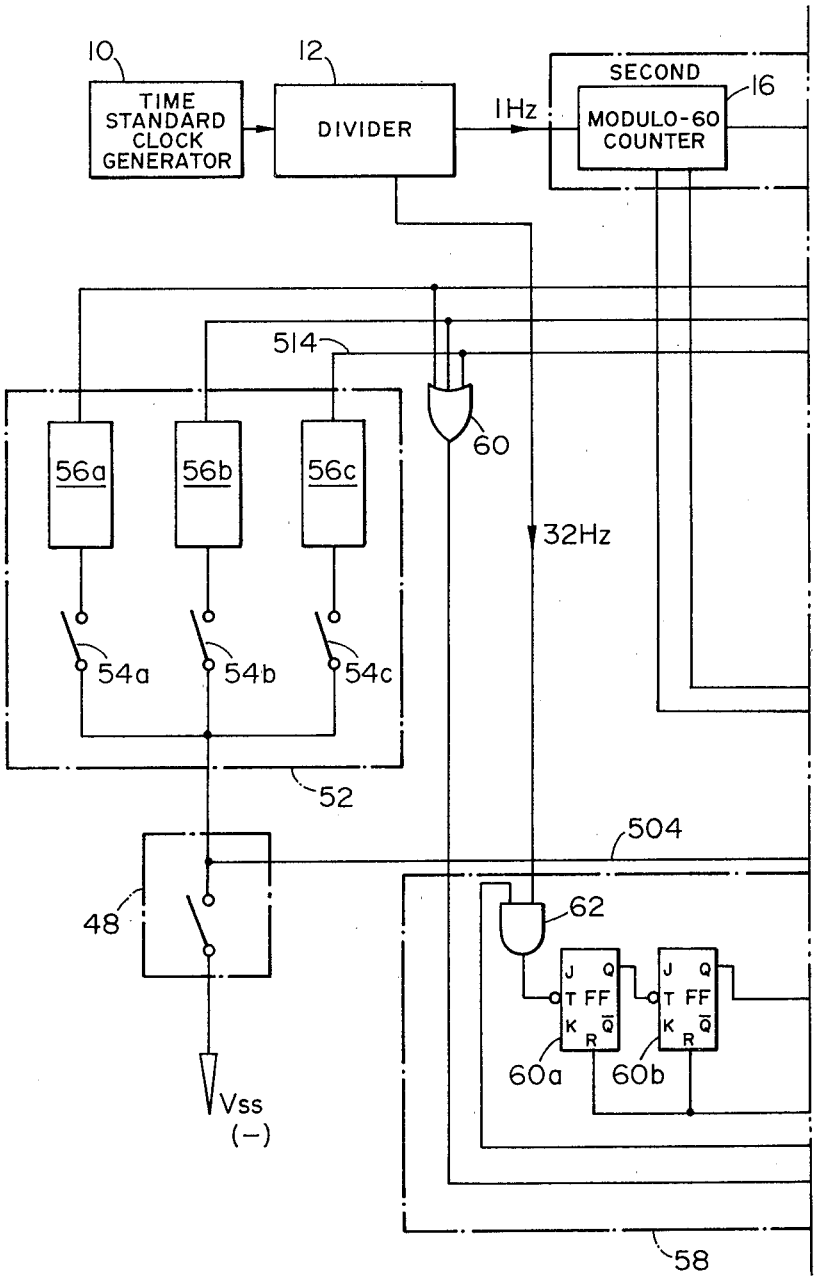
Figure 1B:
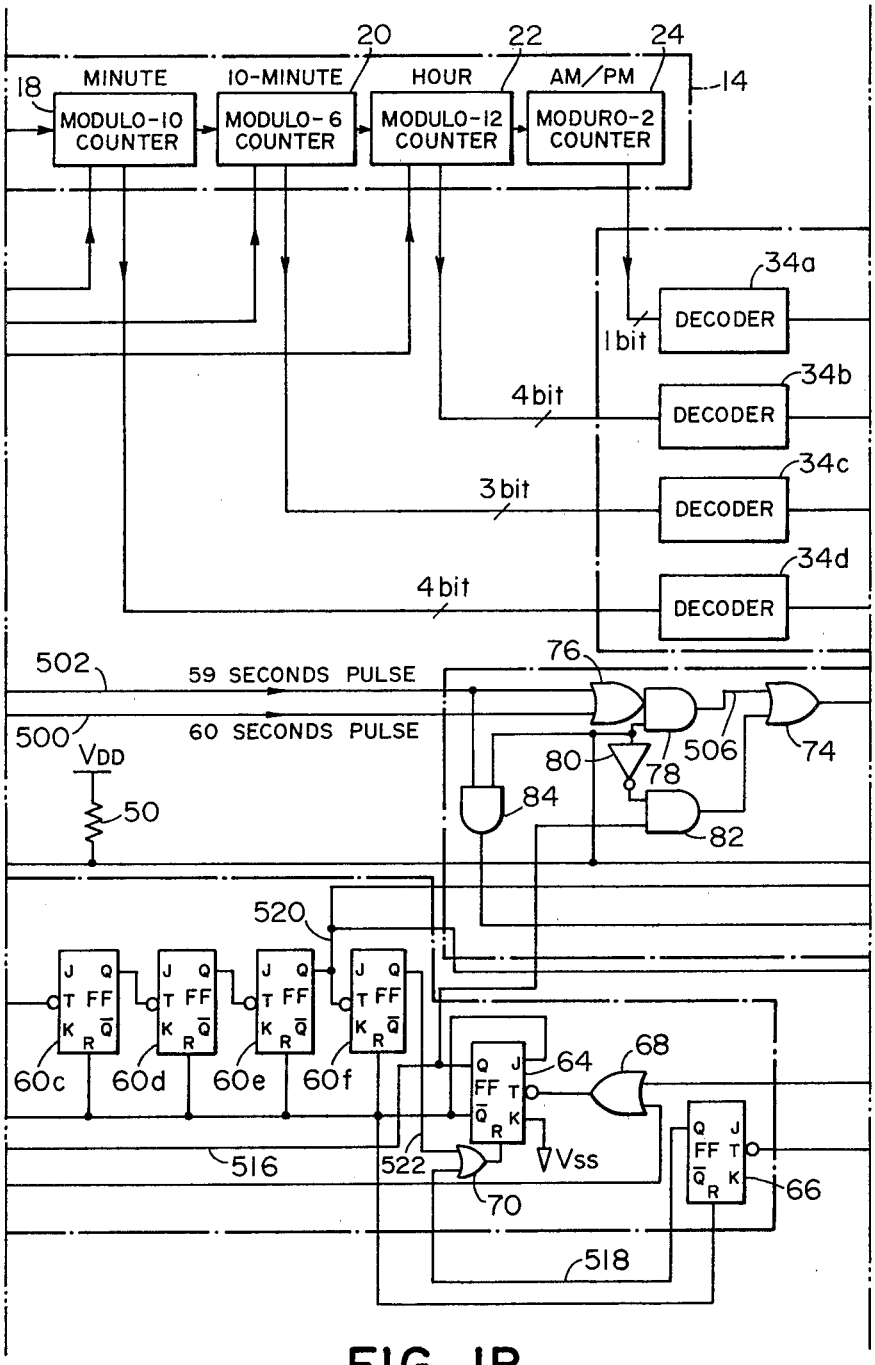
Figure 1C:
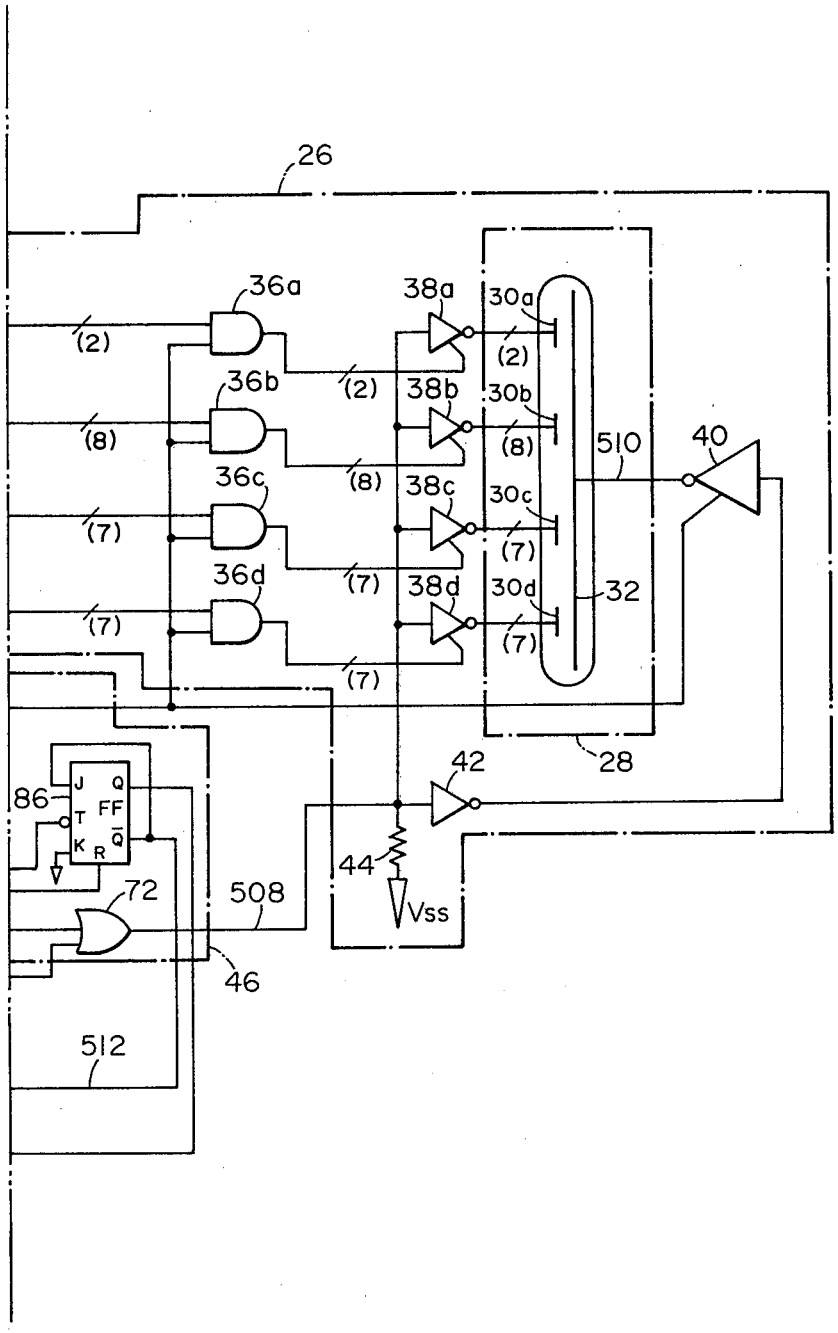

Referring to FIG. 3, shown therein is a circuit diagram illustrating a second preferred embodiment of a time correction circuit in accordance with the teachings of the present invention. In FIG. 3, the standard clock signals from a standard clock signal generator 110 which includes a crystal oscillator, etc. are supplied to a timing circuit 114 by way of a divider 112 after being changed into a pulse train of the required frequency. In this embodiment, to the timing circuit 114 a 1 Hz pulse train is supplied from the divider 112; and from a modulo 60 counter 116, a modulo 10 counter 118, a modulo 6 counter 120, a modulo 12 counter 122 and a modulo 2 counter 124 is supplied signals for the 60 second units, the one minute units, the ten minute units, the hour units and the AM/PM to the time display circuit 126 as time display signals. Each of the minute, hour and AM/PM counters 118, 120, 122 and 114 consists of preset able counters and one can preset the display of each of the counters at a required time. In the time display circuit 126, a EC display section 128 is provided and includes a AM/PM display electrode 130 consisting of two segment electrodes for performing digital type display, an hour unit display electrode 130b consisting of eight segments, a ten minute units display electrode 130c consisting of seven segments, a one minute units display electrode 130d consisting of 7 segments and an opposite electrode 132. Each signal of the seconds, minutes and hours from the above described timing circuit 14 is supplied to decoders 134b, 134c, and 134d of the time display circuit 126 to be changed into the time display signal. The output from the counter 124 of the timing circuit 114 and the output from each of the decoders 134 are supplied to input gates of display electrode drivers 138a, 138b, 138c and 138d consisting of three state inverters by way of AND gates 136a, 136b, 136c and 136d and OR gates 137a, 137b, 137c and 137d and further is supplied to each of the display electrodes 130 after being changed into driving signals.

To the inputs of each of the AND gates 136, each of the OR gates 137 and each of the drivers 138 are supplied control signals from a writing and erasing control circuit which is described below and in this embodiment the time displayed in the EC display section 128 is renewed every 60 seconds. The display is also renewed everytime correction signals are provided in the time correction mode.

To the opposite electrode 132 of the EC display section 128 is provided a voltage of reverse polarity to that of the display electrode drivers 138 from an opposite electrode driver 140 which consists of a three state inverter. To the gate input of the opposite electrode driver 140 not only are provided signals from a writing and erasing control circuit which is described below, but also are provided control signals from an inverter by way of OR gate 141. The display electrode drivers 138 and opposite electrode driver 140 consists of a three state inverter and operates when the gate inputs are "H" to output the driving output corresponding to the input level of the relative display electrode 130 and the relative opposite electrode 132. On the other hand, when the gate input is "L", the display electrode drivers 138 and the opposite electrode 140 stay in the off state. The requested writing action is obtained only when the display electrodes 130 become "L" and the opposite electrode 132 become "L" in the EC display section 28 and the erasing action is only obtained in the reverse way when the display electrodes become "H" and opposite electrode 132 is "L".

In order to change over and control the writing and erasing of the EC display section 128 and at the same time change over from the time display to time correction, a writing and erasing control circuit 146 is provided. In this embodiment, the erasing is performed when a 59 second pulse 600 corresponding to 59 seconds of display time is supplied to the writing and erasing control circuit 146 from the modulo 60 counter 116 of the timing circuit 114. The writing is performed when a 60 second pulse 602 corresponding to 60 seconds of display time is supplied. During ordinary time display, the writing and erasing control circuit 146 performs the erasing and the writing every minute in response to the 59 second pulse and the 60 second pulse, but during correction the erasing and the writing of the display are performed at any time when correction is required.

In the present invention, in order to selectively change over from the time display mode to the time correction mode, there is provided a correction mode change over switch 148 which consists of a push button switch, etc. which can be locked in the ON state. One end of the correction mode change over switch 148 is grounded by way of a resistor 150. In its OFF state a "L" signal is supplied to the writing and erasing control circuit 146 and when the correction mode change over switch is is ON condition a "H" signal is supplied to the writing and erasing control circuit 146. The correction mode change over switch 148 changes from the time display mode to the time correction mode. Selection of the time correction mode by turning ON the change over switch 148 energizes a time correction keyboard 152 and correcting signals are supplied from the time correction keyboard 152 to each counter of the timing circuit 114 by way of a correcting time memory 154.

The keyboard 152 is provided on the operating plate of the timepiece and includes ten numbered keys from zero to nine, four place selection keys M1, M2, H1, and H2 and morning/afternoon selection key AM/PM. The place selection key M1 selects the minutes place, M2 selects the ten minutes place, H1 selects the one hour place and H2 selects the tens of hours place.

The correcting time selected by the keyboard 152 is memorized in the correcting time memory 154 and the memorized correcting time is entered into each of the counters 118, 120, 122 and 124 of the timing circuit 114 to preset each of the counters and further, the writing and erasing signals for the requested correction is supplied to the writing and erasing control circuit 146 from the correction pulse generating circuit 156 which corresponds to the correction time in the correcting time memory 154 to correct the displayed time in the time display circuit 126.

The correcting time memory 154 includes Flip Flop group 158. This FF 158 has the same construction as the keyboard 152 and provides one Flip Flop for each key of the keyboard 152 so that operation of a key sets the corresponding Flip-Flop. In order to adjust the timing between the keyboard 152 and the Flip Flop group 158 a pulse distributor 160 is provided in the correcting time memory 154 and clock pulses from the divider 112 are suppled to the corresponding keyboard and Flip Flop group 158 by the pulse distributor 160 to memorize the right correcting time on keyboard 152 at the Flip Flop group 158. Furthermore, in the correcting time memory 154 is provided a decoder circuit 162 which transmits the preset correcting time put into the Flip Flop group 158 from the keyboard 152 to the counters 118, 120 and 122 of the timing circuit 114.

The decoder circuit 162 consists of a signal converting circuit and provides the correcting time signal to each preset input of the counters 118, 120 and 122 of the timing circuit 114. After conversion of the outputs of the Flip Flop group 158 into the requested correcting signal to change the display time in each of the counters 118, 120 and 122 to the correct time set by the keyboard 152. Each preset action to each of the counters 118, 120 and 122 can be performed by operation of the respective keys M1, M2 and H1 of the keyboard 152 and the correcting time memorized in the Flip Flop group 158 is entered into the counters 118, 120 and 122 from the decoder circuit 162 when the respective of the keyboard 152 is operated. In this embodiment, to AM/PM counter 124 the preset input from the AM/PM key of the keyboard 152 is directly supplied by way of the Flip Flop group 158 and signal converting action of the decoder circuit 162 is not required.

As described above the correcting time selected by the keyboard 152 is supplied to each of the counters of the timing circuit 114 from the correcting time memory 154 and it is understood that in this matter the correcting time can be set. The pulse distributor 160 of the correcting time memory 154 supplies the clock pulses to the Flip Flop group 158 only when the correction mode change over switch 148 is turned ON to select the correction mode and the keyboard 152 is deenergized when the change over switch 148 is in the off state to select the time display mode.

In the correcting time memory 154 is provided an OR gate 164 to which the output of the Flip Flop group 158 is supplied and outputs a correct signal by the operation of any of the keys M1, M2 or H1 of the keyboard 152 as a starting signal to the correction pulse generating circuit 156 described herein below.

The correcting pulse generating circuit 156 includes a FF 166 for partial erasure to weaken the display brightness of the EC display section 128, a FF 168 for correcting time erasure, a FF 170 for correcting time writing and a FF 172 for revive writing to revive to ordinary brightness from a weak display when the correction mode is returned to the ordinary time display mode. To the FF 166 for semi-erasure is supplied the output of the correction mode change over switch 148. To the FF 168 for correcting time erasure is supplied the correcting signal from the OR gate 164 of the correcting time memory 154. To the FF 170 for correcting time writing is supplied the output of the Flip Flop 168 for correcting time erasure. To the input of the FF 172 for revive writing is supplied the output of correction mode change over switch 148 together with the signals from an AND gate 178 by way of an inverter 176.

The correction pulse generating circuit is provided with a timer circuit 174 which supplies signals of shorter pulse width than the writing and erasing pulse width during ordinary time display and the output pulse width of FF 166, 168, 170 and 172 is determined by the time fixed in the timer circuit 174. The input to the timer circuit 174 is a pulse train from divider 112. In this embodiment is utilized a pulse train having a frequency of 32 Hz and the fixed time can be obtained by dividing this pulse train by the Flip Flop group connected in series to the timer circuit 174. In order to reset each Flip Flop in the timer circuit 174, a Flip Flop 180 is provided and various kinds of timing signals are supplied from an OR gate 182 to the input of Flip Flop 180. The output of the timer circuit 174 is supplied to each reset input of Flip Flops 166, 168, 170 and 172 to fix the output pulse of each Flip Flop at a required value. In this embodiment, to the reset input of the Flip Flop 170 for correcting time writing is supplied the output of the timer circuit 174 together with the output of Flip Flop 169 by way of AND gate 184.

As described above, from the correction pulse generating circuit 156 are outputted four kinds of writing or erasing signals and during ordinary time display the 59 second pulse 600 and the 60 second pulse 602 are obtained from the timing circuit 114 as the erasing and writing signal every minute. In order to utilize these four signals as the writing and erasing signals for the time display 126, a writing and erasing control circuit 146 is provided. In this embodiment the writing and erasing control circuit 146 includes an OR gate 186 which puts the EC display section 128 into the writing and erasing state and an OR gate 188 which selects either writing or erasing. The output of OR gate 186 is eventually supplied to each gate input of three state inverters 138 and 140 and the output of OR gate 188 is supplied to the input of the inverters 138 and 140. To the input of OR gate 186 is supplied the 59 second pulse 600 and the 60 second pulse 602 for ordinary time display by way of AND gate 190 and OR gate 192. To the other input of AND gate 190 is supplied the output of the correction mode change over switch 148 by way of inverter 194. The 59 second pulse 600 and the 60 second pulse 602 are outputted from the OR gate 186 to the time display section 126 only when the change over switch is in the off state and the ordinary time display mode is still selected. The ON action of the change over switch 148 to select the correction mode cuts off the time display pulses from the AND gate 190. To the OR gate 186 is supplied the correction pulses from the Flip Flops 166, 170 and 172 of the correction pulse generating circuit 156 and it is understood that the EC display section is put into a state capable of writing or erasing utilizing the correction pulses. From the writing and erasing control circuit 146 is directly supplied the signal from the FF 168 of the correction pulse generating circuit 156 to the time display circuit 126 and the EC display section 128 is placed in a state capable of erasure in the same manner.

On the other hand, to the OR gate 188 of the writing and erasing control circuit 146 are supplied correcting time writing pulses from Flip Flop 170 for correcting time writing, the revived writing pulse from Flip Flop 172 and the 60 second pulse 602. The EC display section 128 enters a writing state when the output of the OR gate 188 is a "H" and the EC display section 128 enters into an erasing state when the output of the OR gate 188 is "L". The 60 second pulse 602 is supplied to the OR gate 188 by way of AND gate 195 and the output from inverter 194 is supplied to the other input of AND gate 195. Accordingly, the turning ON of the change over switch 148 selects the correction mode and disables the 60 second pulse 602.

The second embodiment of the present invention is constructed as described above, and its operation is described herein below with reference to the waveform chart in FIG. 4.

Figure 4:
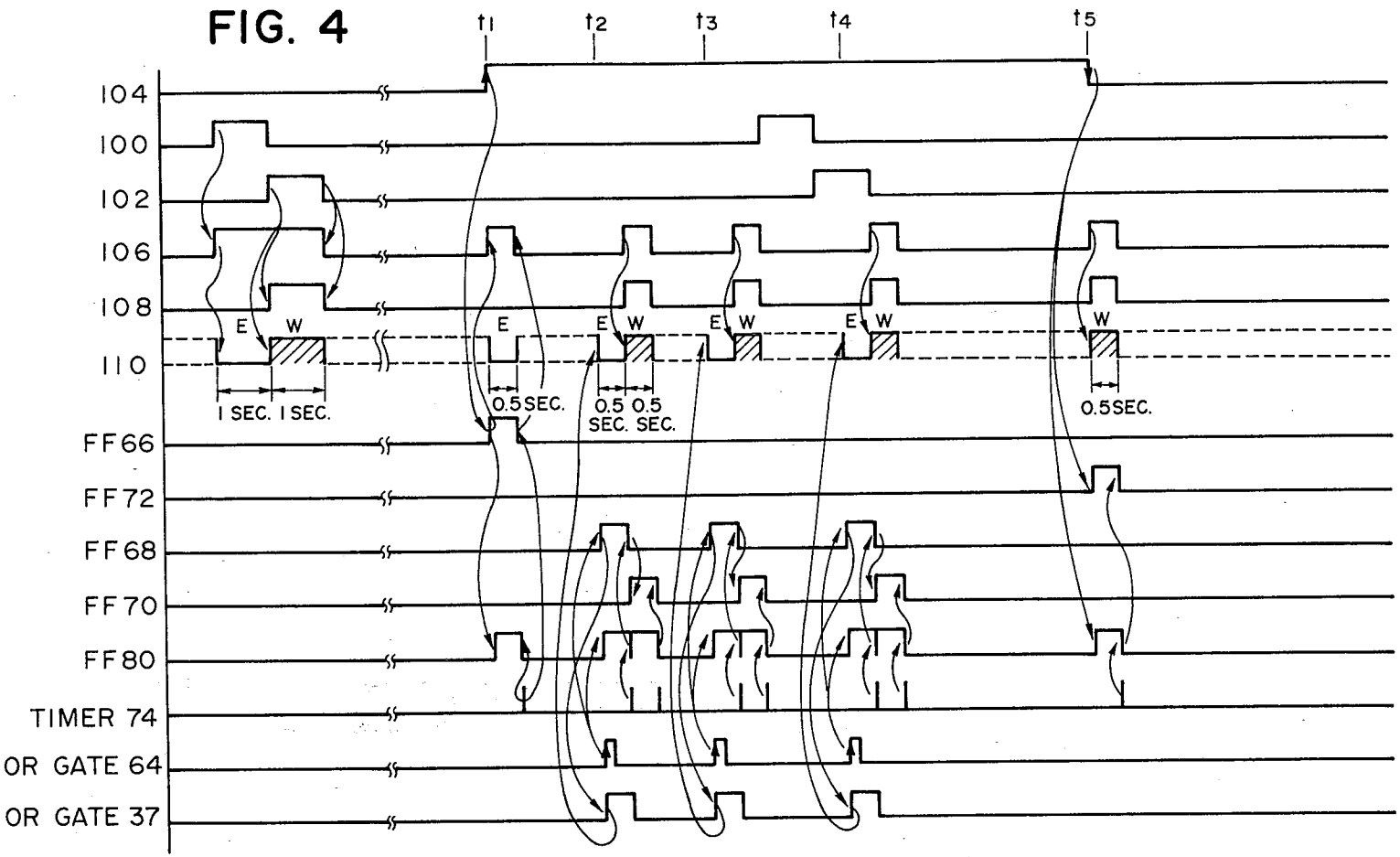
FIG. 4 is a waveform chart of each section in FIG. 3.

In FIG. 4 is shown the ordinary time display state until the time t1 and the correction mode change over switch 148 is in the OFF state. Accordingly, the correction mode change over signal 604 is a "L" and is changed over to a "H" when switch 148 at the time t1 is turned ON.

During ordinary time display, each of the Flip Flops 166, 168, 170 and 172 of the correction pulse generating circuit is in a reset state and the time correction pulses are not generated. Furthermore, the AND gate 190 of the writing and erasing control circuit 146 is in an open state in response to the correction mode change over signal 604. In this state, when the 59 second pulse 600 having a pulse width of 1 second is supplied from the modulo 60 counter 116 of the timing circuit 114 to the writing and erasing control circuit 146, this "H" level signal passes through the OR gate 192, the AND gate 190 and the OR gate 186 (signal 606) to be supplied to the gate input of the display electrode 138 through each AND gate 136 of the time display circuit 126 and to the gate input of the opposite electrode drivier 140 so that the EC display section 128 is in a state of preparation for writing or erasing. Since the output 608 of the OR gate 188 is a "L" at this time, the display electrode 130 of the EC display section 128 becomes a "H" and the opposite electrode 132 (signal 610) becomes a "L" so that the EC display section 128 is erased during the "H" period of the 59 second pulse 600. Accordingly, the time displayed on the EC display section 128 can be erased by the 59 second pulse 600. At the indicated time of the 60 second pulse 602, the 60 second pulse 602 is outputted and the output of OR gate 186 is maintained in a "H" state. The EC display section 128 is kept in a state of preparation for writing control. The opposite electrode 132 (signal 610) of the EC display section 128 becomes a "H" while the display electrode 130 becomes a "L" by the output 608 of the OR gate 188 to perform the writing action on the display section 128 so that the contents of the timing circuit 114 is written into the EC display section 128. In the manner described above, the ordinary time display is performed and described hereinafter is the correcting action following the time t1.

In this illustrated embodiment, a correcting time action is started by the turning ON of the mode change over switch 148 and the colorization of the EC display section 128 is set to be lower than one half of normal when the mode change over switch 148 is turned on. During time correction to be described hereinafter, since the erasing pulse width is smaller than the normal time display pulse width, the erasing pulse for correction could not completely erase the ordinary time display and the time display prior to correction would make it hard to perform the correct action. As a result, upon selection of the correction mode, the decolorization of the EC display section 128 enables complete erasure of the actual time by lowering the colorizing degree of the EC display section 128. In other words, when the correction mode change over signal 604 is switched to a "H" at the time t1, the AND gate 190 of the writing and erasing control 146 is closed and the 59 second pulse 600 and the 60 second pulse 602 from the timing circuit 114 are disabled during the correction mode.

On the other hand, the correction mode change over signal 604 resets the Flip Flop 166 for partial erasure by the correction pulse generating circuit 156 and the EC display section 128 is placed in a state of preparation for writing and erasing by the output signal 606 from the OR gate 186 of the writing and erasing control circuit 146. In this state, the erasing action of the EC display section is started at the time t1 since the output 608 of the OR gate 188 is a "L". At the same time, the Q output of the Flip Flop 166 is supplied from the OR gate 182 to the Flip Flop 180 to release the reset signal from the timer circuit 174. This timer circuit 174 divides the pulse train of 32 Hz from the divider 112. Consequently, the pulses are outputted from the timer circuit 174 after 0.5 seconds have elapsed and the Flip Flops 166 and 180 are put in a reset state. Upon completion of the erasing action, the timer circuit 174 returns to the reset state. By the erasing action during the 0.5 seconds described above, the brightness of the EC display section 128 is weakened and erasure in an amount equal to one half of normal allows the user to recognize the correcting state or prepare for the next correction display.

The action and the operation of the keyboard 152 is described hereinafter in accordance with the teachings of the present invention.

Taking one example of the correction of the display time to be "10:34" the keyboard 152 is operated so that H2, H1, M2 and M1 are set respectively to be 1, 0, 3 and 4 to perform the required time correction. In other words, by the operation of a "1" on key H2 of the keyboard 152, the decoder circuit 162 supplies a correcting signal of "10 hours" to the preset input of the hour unit counter 122 and the subsequent keyboard operation of key H1 supplies a signal to the preset input of the modulo 12 counter 122 which shows the hours units so that the preset data of "10 hours" is written into the counter 122. In the same manner, to the input of the ten minute units counter 120 by the keyboard operation of a 3 the preset data of modulo 6 counter 120 showing that ten minute units is supplied from the decoder 162 and in this state the keyboard operation of key M2 enters this counter 120. The correcting time of 4 is written into the modulo 10 counter 118 showing the one minute units in the same manner.

At the same time as the entering into each of the counters of the timing circuit 114 of the correcting time, the correction pulse generating circuit 156 performs the correction time writing action. In this embodiment, the correcting time writing of the hours units is performed at t2, the correcting time writing of the hour units and ten minute units is performed at the time t3 and the writing of all of the correcting time of the hour units, ten minute units and the one minute units is completed at the time t4. At each correction time writing the correction of the AM/PM must be performed at the same time if required. Since the correction writing action at each of the above described times t2, t3 and t4 shows a different contents of the timing circuit 114 at those times and the correction writing action itself is exactly the same, the correction writing action at the time t2 is described below.

The operation of the key H1 of the keyboard 152 supplies the input from the OR gate 164 of correction time memory 154 to the Flip Flop 168 of correction pulse generating circuit 156 for correcting time erasing and the EC display section 128 is in a state of preparation for writing and erasing since the Flip Flop 168 is set ON. At this time, the output 608 of the OR gate 188 is a "L" and the EC display section 128 is in an erasing state. The output of the OR gate 164 is further supplied from the OR gate 182 to the Flip Flop 180. The timer circuit 174 performs the timer function of 0.5 seconds in the same manner as the partial erasing action described above when selecting the correcting mode and the Flip Flop 168 is maintained in a reset state for 0.5 seconds although the timer output immediately resets this state. Accordingly, the supply of the erasing signal to the EC display section 128 weakens the display when the correction mode change over switch 148 is turned ON and the display is completely erased by the erasing pulses of small pulse width.

Subsequently, the Flip Flop 168 is reset and its output sets Flip Flop 170 ON for correction time writing. Accordingly, the signal 606 is still outputted from the OR gate 186 of the writing erasing control circuit 146 and the EC display section 128 is maintained in a state of preparation for writing and erasing. Since the signal 608 of a "H" is also outputted from the OR gate 188 at this time, it is understood that the EC display section 128 enters the writing state. The above described timer circuit 174 again starts the timer action of 0.5 seconds in response to the Q output of the Flip Flop 170 and during this time the corrected time from the timing circuit 114 can be written into the display circuit 126. The writing brightness is weakened and thinner in coloring than the ordinary time displayed.

As described above, the first time correction is performed at the time t2 and the hour units counter 122 of the timing circuit 114 is the only one corrected. The time display circuit 126 can display newly corrected time by means of correctly displaying the corrected time of the ten minute units and one minute units at the times t3 and t4 in the same manner as described for the corrected hour units. During the correction mode, the 59 second pulse 600 and the 60 second pulse 602 are disabled by the writing and erasing control circuit 146 and the normal correcting action is disabled.

In the following is described the action at time t5, wherein the correction mode change over switch 148 is turned off and the circuitry changes from the correction mode to the ordinary time displaying mode.

During correcting time a weakened display is created and continuation in this state during ordinary time display produces a problem since a thin display exists right after correction. In order to completely revive the display to ordinary display brightness, revive writing action is performed when the switch 148 is turned off at the time t5. In other words, a signal 604 from switch 148 becomes a "L" and is inverted by the inverter 146 and supplies the set input from AND gate 178 to Flip Flop 172, for revive writing. By setting the Flip Flop 172 the writing and erasing control circuit 146 places the EC display section 128 in a writing state. The Flip Flop 172 starts the timer action of the timer circuit 174 so as to output a writing signal for 0.5 seconds in the same manner as each of the Flip Flops described above and during this period the display of the EC display section 128 is revivingly written back to ordinary brightness. Accordingly, the ordinary display brightness can be obtained right after the completion of the correcting action.

In this embodiment, both the pulse width of the writing and the erasing pulse for time correction are set to be small and the setting of the small pulse width provides fast correction of the time display. As described above, when the switch 148 is turned on the operation of keyboard 152 obtains the required time correction action and the erasing and writing of the EC display section 128 is performed in a short time since the correction is performed by a time correcting pulse of smaller width than an time display pulse which makes it possible to perform fast correction. During such correction time, the time displayed on the EC display section 128 is a little thinner and weaker in color than the ordinary time display, but is possible to obtain a sufficient display for correction. Furthermore, in this embodiment, the partial erasing action at the time of selecting the correction mode makes it possible to perform complete erasing action utilizing an erasing pulse having a smaller pulse width than the pulse utilized during ordinary time display and to perform correcting time writing and erasing utilizing a pulse of small pulse width afterwards.

Also, both pulse widths of the writing and the erasing for time correction are said to be small, but is possible to provide a circuit wherein only the writing pulse is of small pulse width and the erasing pulse is of normal pulse width. Utilizing such a structure it is possible to omit the partial erasing action at the time the correction mode is selected. It should be apparent from the above that since the EC display section 128 is driven by writing and erasing pulses of smaller pulse width at the time of time correction than during the ordinary time display, fast correction can be performed on the EC display section having slow response speed and the time correcting circuit can be utilized in a wide number of applications for digital or analog display type timepieces.

It should be apparent to those skilled in the art that the above described embodiments are merely illustrative of but a few of the many possible specific embodiments which represent the applications and the principals of the present invention. Numerous and various other arrangements can be readily devised by those skilled in the art without departing from the spirit and scopy of the invention.

We claim:

1. A time correcting circuit for a timepiece with electrochromic display comprising:

a means for generating time standard clock signals;

a timing circuit having counters for counting said time clock signals and for generating time display output signals;

a time display circuit having an electrochromic display section for displaying said output signals from said counters;

a correction mode changeover switch for selectively switching between a time display mode and time correction mode;

a correcting circuit which functions only when said correction mode is selected to change the contents of said counters in said timing circuit;

a writing and erasing control circuit for controlling the timing of writing and erasing of said electrochromic display section in response to the selected mode of said correction mode changeover switch; and a correction pulse generating circuit for outputting time correction writing pulses of a smaller pulse width than writing and erasing pulses during normal time display when said correction mode is selected by said correction mode changeover switch.

2. A time correcting circuit for a timepiece with an electrochromic display according to claim 1, wherein at the time of selecting the time correction mode an erasing signal of weak coloring is provided by said writing and erasing control circuit to said electrochromic display section.

3. A time correcting circuit for a timepiece with an electrochromic display according to claims 1 or 2, wherein said correcting circuit comprises at least one ON-OFF switch and said counters are advanced corresponding to the operation of said ON-OFF switch only when said time correction mode is selected by said correction mode changeover switch.

4. A time correcting circuit for a timepiece with an electrochromic display according to claims 1 or 2, wherein said correcting circuit comprises a keyboard comprising at least ten keys from 0 to 9; and a decoder circuit presetting the number signals entered from said keyboard to said counters only when said time correcting mode is selected by said time correction mode changeover switch.

5. A time correcting circuit for a timepiece with an electrochromic display according to claims 1 or 2, wherein the color intensity of said electrochromic display is returned to a normal color intensity when said time correction mode is switched to said time display mode by said correction mode changeover switch.

* * * * *